US006186505B1

(12) United States Patent
Perrie et al.

(10) Patent No.: US 6,186,505 B1
(45) **Date of Patent: *Feb. 13, 2001**

(54) LIKE KIND MONEY BOARD TABLE GAME

(75) Inventors: Kenneth Allan Perrie, Groton, CT (US); Olaf Vancura, Las Vegas, NV (US)

(73) Assignee: Mikohn Gaming Corporation

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/311,648

(22) Filed: May 13, 1999

Related U.S. Application Data

(60) Provisional application No. 60/085,293, filed on May 13, 1998.

(51) Int. Cl.[7] ..... A63F 3/00

(52) U.S. Cl. ..... 273/274; 273/236; 273/237; 463/16; 463/17

(58) Field of Search ..... 273/274, 138.1, 273/139, 141 A, 236, 237; 463/11, 13, 16–17

(56) References Cited

U.S. PATENT DOCUMENTS

D. 273,310 * 4/1984 Pohanka .
3,819,186 * 6/1974 Hinterstocker .
4,234,186 * 11/1980 Forrest .
4,260,159 * 4/1981 Hoffman .
4,321,673 * 3/1982 Hawwass .
4,643,425 * 2/1987 Herzenberger .
4,744,098 * 5/1988 Grabowski .
4,792,137 * 12/1988 McKechnie .
5,019,973 5/1991 Wilcox et al. .
5,098,107 3/1992 Boylon et al. .
5,570,885 * 11/1996 Ornstein .
5,775,993 * 7/1998 Fentz .

OTHER PUBLICATIONS

Un–Reel Slots Red–Five Gaming LLC., Encinitas, CA 92024.

* cited by examiner

*Primary Examiner*—Benjamin H. Layno
*Assistant Examiner*—Vishu Mendiratta
(74) *Attorney, Agent, or Firm*—Aaron Passman

(57) ABSTRACT

A casino game and method therefor is described having a gaming device having a play board. The play board has disposed thereon a plurality of groups wherein each of the plurality of groups has at least one like-kind element, one or a plurality of wild elements, one or a plurality of lose elements, and one or a plurality of separate wager elements. A wagering table is provided. The wagering table has separate wager areas for wagering on the occurrence made group or the occurrence of at least one separate wagering element.

A device randomly selects during each play of the game an element from a like-kind elements, the wild elements, the separate wagering elements, and lose elements for displaying one of the elements on the play board during each round of play. The device continues to randomly select a next element until all of the like-kind elements in any one group are completed. The completion can also occur wherein all of the elements in a group are selected or wherein a randomly selected wild element completes the group. When a group is complete the game ends, or when a lose element is selected, the game ends.

11 Claims, 3 Drawing Sheets

90
22
10
98
RR 1
Red 1
Red 2
Red 3
Yellow 1
Yellow 2
Yellow 3
R.R. 2
Orange 1
Orange 2
Orange 3
Lt. Purple 1
Lt. Purple 2
Lt. Purple 3
R.R. 4
Lt. Blue 1
Lt. Blue 2
Lt. Blue 3
Chance
Purple 1
Purple 2
R.R. 3
Green 1
Green 2
Green 3
CC
Blue 1
Blue 2
20
94
92
40
LIKE KIND MONEY BOARD
350
96
96
30
G.O.
50
P0
P1
P2
P3
P4
P5
312
312
312

22
340
DRIVER
350
LIKE KIND MONEY GAME
DRIVER
352
340
DISPLAY
330
20
304
320
RNG
DRIVER
MEMORY
μP
302
300
306
310
BUFFER
GO
380
314
SWITCH
SWITCH
312
316
312
312
P0
P1
PN

LIKE KIND MONEY BOARD TABLE GAME

This disclosure relates to a provisional application U.S. Ser. No. 60/085,293 filed on May 13, 1998.

BACKGROUND OF THE INVENTION

1. Field of the Invention

The present invention relates to casino games and, more particularly, to casino games that use a wagering table located near the gaming device.

2. Statement of the Problem

One popular form of casino game is the use of a wagering table in association with a game such as big wheel games and roulette. A continuing need exists in the gaming industry to come up with new, creative and exciting gaming devices having separate wagering tables.

A game that is popular worldwide which has not been adapted into the environment of the casino is the MONOPOLY® board game. Such board games are played at home or in an environment which usually requires several hours to play to completion. Such a length of time is undesirable in the environment of a casino where players expect to win or lose in a short period of time. Hence, a need exists to adopt well-known board games from the home environment into the environment of a casino.

3. Solution to the Problem

The present invention provides a new type of casino game using a wagering table that provides a new form of gaming device using winning combinations based upon like kind.

The present invention further provides a solution to the problem by providing a large lighted board containing a modified rendition of the MONOPOLY® game board and a separate wager table also providing a modified representation of the MONOPOLY® board game onto which the player's place wagers.

U.S. Pat. No. 5,019,973 has a poker game for video play where a player makes a first bet to receive a card hand and then a second bet to have another card displayed. If that card matches the value or suit of a first card in the hand, the first card changes to the value or suit of the second card. If the second card matches the value and/or suit of the hand, the cards in the hand are wild and are any rank. On the video the cards are superimposed by the wild card. Additionally, the player can bet for more cards too be wild.

U.S. Pat. No. 5,098,107 has a game with a payoff chart. Blackjack with a standard deck of cards and "no value" cards preferably in various colors. The bets are on Blackjack, the no value cards and that the first two cards will be related by suit value or color. For rare cards a progressive jackpot is possible. Balls with cards on them may be dispensed randomly wherein four balls go to each of four containers. Bets on three or four of a kind, two pair on value or color can be made. A selection device for color numbers can be used to bet on.

U.S. Pat. No. 4,234,186 has a board game with fruit around a square board. If a player lands on fruit of like kind a prize is won. Dice thrown move their pieces around the board. Horse shoe spots are on the board and a card is given upon landing there; three horse shoe cards win a prize. The corners are special so that if all corners are landed on a card of each group is collected and the game won and the jackpot collected.

No casino with an electronic game board to provide the random board movement, collect the bets and distribute the winnings is known.

SUMMARY OF THE INVENTION

A casino game and method therefor is described having a gaming device having a play board. The play board has disposed thereon a plurality of groups wherein each of the plurality of groups has at least one like-kind element, one or a plurality of wild elements, one or a plurality of lose elements, and one or a plurality of separate wager elements. A wagering table is provided. The wagering table has separate wager areas for wagering on the occurrence made group or the occurrence of at least one separate wagering element.

A device randomly selects during each play of the game an element from a like-kind elements, the wild elements, the separate wagering elements, and lose elements for displaying one of the elements on the play board during each round of play. The device continues to randomly select a next element until all of the like-kind elements in any one group are completed. The completion can also occur wherein all of the elements in a group are selected or wherein a randomly selected wild element completes the group. When a group is complete the game ends, or when a lose element is selected, the game ends.

A casino game preferably has a gaming device having a play board. The play board may have disposed thereon a plurality of groups wherein each of the plurality of groups has at least one like-kind element, one or a plurality of wild elements, one or a plurality of lose elements, or one or a plurality of separate wager elements. There may be a wagering table having separate wager areas for wagering on the occurrence of a group or the occurrence of at least one separate wagering element. A device for randomly selecting during each play of the game an element from the like-kind elements, the wild elements, the separate wagering elements, and lose elements is preferred. The device may display one of the elements on said play board during each round of play and can randomly select a next element until all of the like-kind elements in at least one group is completed. The completion occurring wherein all of said elements in the one group are selected or wherein a randomly selected wild element completes said group. The completion causing said game to end or the game further ending when a lose element is selected.

A game for casino play, wagering and environs might include a playing board for game play by one or more players and a wagering area. The game may have an electronic display board viewable by the one or more players. A random number generator is preferably coupled to the electronic display board. The random number generator operatively couples to deliver the game play to the one or more players. A wagering area is for placement of one or more wagers on random occurrences on the electronic display board during the game play. A system configuration can couple to the electronic display board to relate the game play. The wagering area is preferably operatively coupled to the electronic display board and responsive to the game play. The wagering area can be operatively coupled to the system configuration for determining winnings for the one or more wagering players.

A game for casino play, wagering and environs might include a playing board for game play by one or more players. An electronic display board may be viewable by the one or more players. A plurality of groups are most preferably positioned about the electronic display board and related to the game play. A plurality of elements in each of the plurality of groups are preferably of like kind. A random number generator may couple to the electronic display board and the random number generator operatively coupled to select elements to the one or more players. An identifier for each of the elements could establish its relationship with respect to other elements of like kind. Each identifier might be shown on the electronic display board for view by the players. A wagering area is most preferably provided for placement of one or more wagers on random occurrences of like kind on the electronic display board during the game play. A system configuration couples to the electronic display board to relate the game play.

The wagering area could be operatively coupled to the electronic display board. The system configuration can be coupled to the wagering area and the electronic display board for determining when identifiers have been randomly selected for each of the one or more players in sufficient quantity to distribute a win to the one or more wagering players. The electronic display board may also include wild areas and each wild area may be randomly selected during the mode of play with each such randomly selected wild area optionally available to the player for use as at least one identifier.

The system configuration preferably couples to the electronic display board and the wagering area and relates automatically the game play for determining winnings for the one or more wagering players. The random number generator can exhibit one or more dice. The random number generator might illuminate an element on the game board.

DETAILED DESCRIPTION OF THE INVENTION

1. Overview

Figure 1:
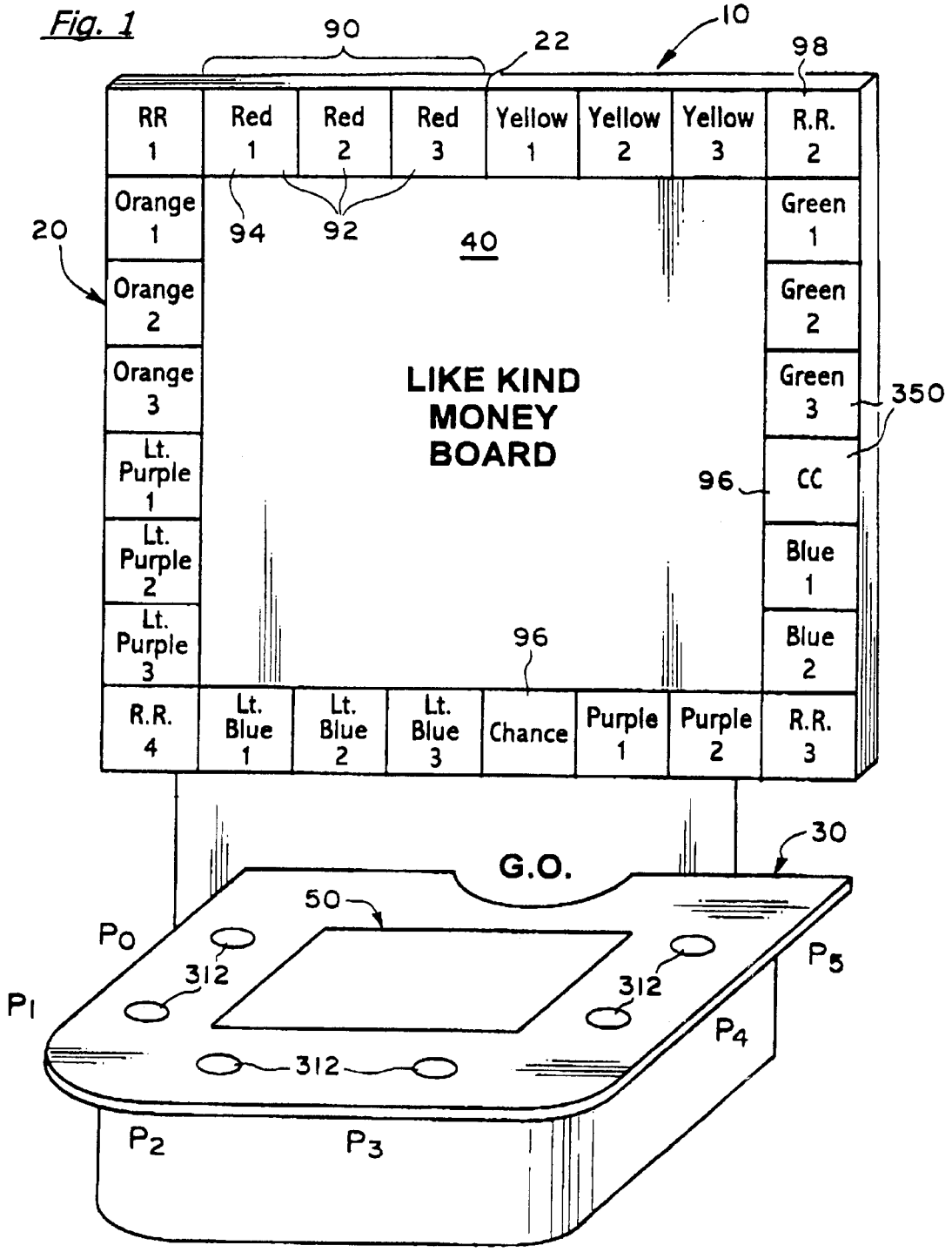
FIG. 1 is a perspective view of the casino game of the present invention.
Figure 2:
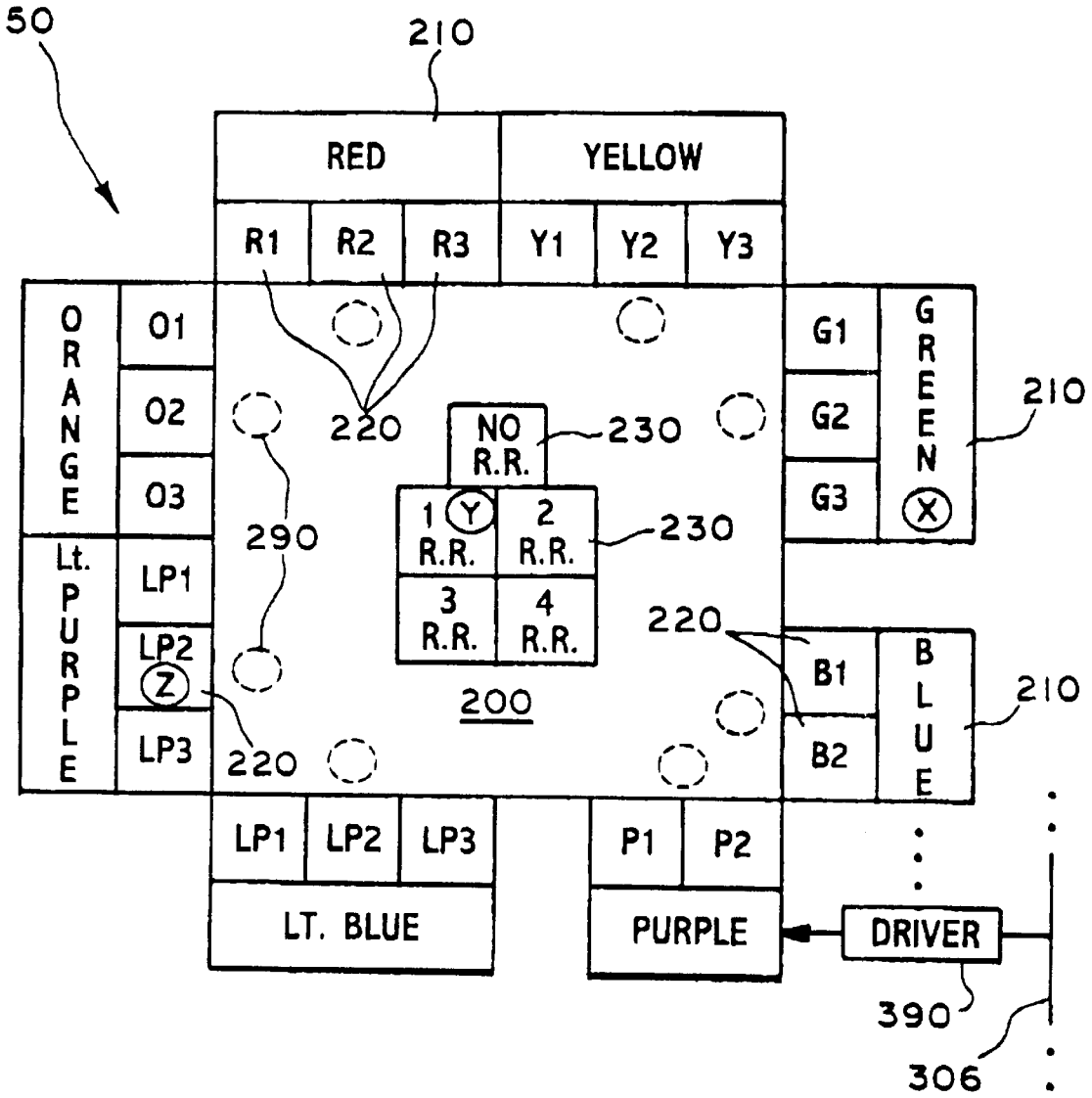
FIG. 2 sets forth the table wager area representation of FIG. 1.

In FIG. 1 is the casino game 10 of the present invention which includes a lighted board 20 and a player table 30. The lighted board 20 has a game layout 40 placed thereon such as a game layout similar to the prior art MONOPOLY® game board. Likewise, in FIG. 1 is a wager area 50 which is also a modified representation similar to the game board (as shown in FIG. 2) onto which players place wagers to play the game.

In FIG. 1, six player positions P0 through P5 are shown. A game operator GO position is also shown in FIG. 1. Any number of players may be provided for around the table 30.

The board 20 has located around its periphery 22, in the preferred embodiment 28 MONOPOLY® lighted spaces 350 similar to the traditional MONOPOLY® board game with some exceptions. The traditional MONOPOLY® board game has 40 spaces. In this embodiment, the utilities, and the comers of the traditional game are eliminated and the railroads are located in the corners. Luxury Tax and Income Tax spaces are also eliminated.

As shown in FIG. 1, the game board representation 40 on a lighted board 10 shows the following eight color groups 90: red, yellow, green, blue, purple, light blue, light purple, and orange. In the actual MONOPOLY® board game, similar color groups exist with each group of color elements 92 having addresses 94 such as the blue group: blue 1 (Board Walk) and blue 2 (Park Place). The actual addresses 94 could optionally also be shown on the representation 40. For clarity each color group 90 has the individual elements 92 numbered. For example, the color group 90 for red has elements 92 termed with the following identifiers 94: RED1, RED2, and RED3. Likewise, each railroad has a name such as Shortline and those names could also appear in the corners of the representation along with the railroad symbol. For clarity, FIG. 1 uses: RR1, RR2, RR3, and RR4.

It is to be expressly understood that while FIG. 1 (and subsequently FIGS. 2 and 3) use the MONOPOLY® board game as an example for adopting a conventional game board into a casino environment, that techniques discussed herein are not limited to board games in general. Indeed, a new form of a gaming device is disclosed based upon "like-kind" winning combinations. Clearly without reference to any conventional board game or any other type of board game, the peripheral arrangement shown in FIG. 1 can be utilized for game play. For example, the group 90 could simply be colors without being tied into any other game. The railroads could comprise an entirely different color or symbol (such as a four-leaf clover). In addition, "CHANCE" and "COMMUNITY CHEST" in FIG. 1 could be other colors or symbols such as the picture of a "joker."

From a functional game theory operation viewpoint, a plurality of groups 90 are provided. In FIG. 1, eight groups 90 are provided. Each group comprises a plurality of "like-kind" elements 92. The "like-kind" elements 92 can be any suitable identifier such as, but not limited to: color, numbers, card representations, sport images, designs, or a combination thereof. For example, one group could be a "like-kind" color and a second group could be numbers, etc. Furthermore, the elements 92 in each group 90 can comprise any number greater than zero. The elements must be of "like-kind", but not need to be truly identical. For example, in the MONOPOLY® board game each colored element 92 has an address. Likewise, in the general operation of the game presented herein, each color element could have a separate, property identifier 94 to further identify the element in the group 90.

In addition to the "like-kind" groups 90 are the "wild" elements 96. In FIG. 1, two "wild" elements (CC and CHANCE) are utilized. It is to be expressly understood that any number of such "wild" elements could be utilized. Furthermore, it is to be expressly understood that such elements are optional and may or may not appear in conjunction with the "like-kind" game of the present invention. Furthermore, such elements 96 can also be of any type of identifier including color, graphic, alphanumeric, etc.

Finally, in the preferred embodiment, is the use of corner elements 98. In the preferred embodiment, such corner elements are of "like-kind" (such as the railroad), but can also be entirely separate and unrelated to each other. These additional elements can also be color, graphic, alphanumeric, etc. and are also optional under the teachings of the present invention.

Under the theory of the game 10 of the present invention, a player wins when "like-kind" in a group 90 is obtained. Typically, the greater number of elements 92 in a group 90, the higher the payoff. In addition, payoffs can be made when a single element 92 in the group 90 is obtained during the play of the game or, a payoff can be made if the single element 92, as identified 94, is obtained. Hence, at least three payoff occurrences occur functionally under the teachings of the present invention with respect to like-kind groups 90: obtaining the entire group 90, obtaining a specific element 92 in the group, or obtaining any one of the elements in the group 90 during the play of the game. The "wild" areas 96 add further excitement to the game in that they can be used to complete a "like-kind" grouping 90 as will be explained more fully subsequently. Finally, the players can wager upon the corners as a separate wager during the play of the game. Hence, it is to be expressly understood that while the MONOPOLY® board game is used as an example showing how such a game can be adapted into a casino environment, the teachings of the present invention are not limited to board games, nor is it limited to adopting a conventional board game to the casino environment. Rather, a "like-kind" gaming device is disclosed which can be used in conjunction in the preferred embodiment, with a wagering table.

It is to be expressly understood that the teachings of the present invention are also not limited to the representation shown in FIG. 1. It is possible to modify the teachings of the present invention to be adapted to the video gaming device environment such as JOKER POKER has done, to facilitate use of this game in a computer, intranet, or internet environment such that players may be located at individual, but remote locations and access to play the game.

2. Wagering Area

In FIG. 2, the wagering area 50 is shown in greater detail and also preferably includes a representation 200 of the game board which in the example is MONOPOLY®. A player has options of betting on a colored "like-kind" group 90 such as, for example, the red group by placing a wager in area 210 or a player may place a bet on an individual property such as placing a bet in area 220. Likewise, a player may bet the number of railroads hit by placing a wager in areas 230.

In this fashion, the players may wager based upon the following payout table:

TABLE I

| Winning Combination | Pays | House Edge |
|---|---|---|
| Purple Group | 3 to 2 | 12% |
| Light Blue Group | 5 to 1 | 20% |
| Light Purple Group | 5 to 1 | 20% |
| Orange Group | 5 to 1 | 20% |
| Red Group | 5 to 1 | 20% |
| Yellow Group | 5 to 1 | 20% |
| Green Group | 5 to 1 | 20% |
| Blue Group | 3 to 2 | 12% |
| A specific individual element (or property) hit (i.e., color or railroad) | 2 to 1 | 16% |
| 0 Railroads | 3 to 2 | 12% |
| 1 Railroads | 3 to 2 | 13% |
| 2 Railroads | 3 to 1 | 18% |
| 3 Railroads | 10 to 1 | 13% |
| 4 Railroads | 50 to 1 | 20% |

The statistical average length of play based upon Table I is 7.7 plays. Note that the railroads, although of a "like-kind" are not considered to have color and so are not one of the eight colored "like-kind" groups in this particular version of the game. Hence, the accumulation of multiple or all railroads does not complete this version of the game.

It is to be expressly understood that Table I represents only an 10 example of the payoff combinations under the teachings of the present invention. In Table I, there are eight colored "like-kind" groups 90 based upon the game of MONOPOLY®. Clearly, the teachings of the present invention are not limited to eight groups 90 as any suitable number more or less than eight could be utilized. Furthermore, the number of elements 92 in each group 90 affects the payoff and the house edge.

In the preferred embodiment shown in FIG. 1, there are six colored groups 90 having three "like-kind" elements 92 and two colored groups 90 having only two "like-kind" elements 92. The number of specific individual elements 92 in a like-kind group 90, under the teachings of the present invention, can be of any suitable number greater than zero. For example, in some designs, there may be a number of groups 90 having four or five "like-kind," but individual elements 92 and two or three groups 90 having three elements 92, etc. The number of groups 90, the number and distribution of elements 92 within specific groups 90 clearly affects the statistically payoff and house edge calculation and such may vary considerably from that set forth in Table I.

In FIG. 2, it is to be understood that the group wager area 210 for a color applies to all of the colors shown in FIG. 2 whereas the individual property wager area 220 applies to the occurrence of a specific red property. For example, and as shown in FIG. 2, placing a wager any where in the area 210 places a wager for the colored group which according to Table I for the red group is 5 to 1. Hence, a one dollar wager pays five dollars. Of course, any form of wager could be utilized under the teachings of the present invention. A player placing a wager in any one of the individual areas 220 which when that specific individual property is hit, according to Table I above, pays two to one, so that if one dollar was bet two dollars would be paid.

Table I illustrates two of the three types of bets that can be made under the teachings of the present invention. The first type of wager is made upon obtaining a "like-kind" group of individual elements. These are shown by the color winning combinations in Table I. The second wager is based upon any individual element being hit. Finally, and not shown in Table I, is the placing of a wager on the "like-kind" which could simply be the color such as the color red, or the identity of the group such as railroad without identifying a particular individual property. A separate area such as shown by areas 290 in FIG. 2 could be used to place these wagers.

As shown in FIG. 2, a player may make a wager in any one of the areas 220 for a color group. For example, for the color group blue, whether a player places a wager blue B1 or B2 is material. It represents the specific individual property of that color element being hit. The discussion set forth above for the red color group and the individual property color of red applies to all of the remaining colors. In this fashion, the game operator GO is able to determine who is to be paid once the game is over. The game is not over until a color group is completed. At the point in time when a color group is obtained, all players are paid off according to the placement of their wagers prior to the game and as set forth in the payoff schedule of Table I.

With respect to wagering on the railroads, the player can bet any one of the five areas 230 shown in FIG. 2. For example, four railroads could be selected by a player to make a wager. Hence, when the overall game ends (i.e., any colored group is completed), then a determination is made as to how many railroads have been hit.

The wager area 50 on table 30 can be of any suitable geometric arrangement and does not have to resemble the game board. For example, the eight color groups 210 could be eight squares arranged in a matrix, the individual properties 220 could be similarly arranged in a separate matrix as could the railroad areas 230.

Under the teachings of this preferred embodiment, the game ends when a colored group is obtained. Examples of a colored group being obtained and ending the game are, but not limited to: three reds; two reds and a CHANCE; or two reds and a COMMUNITY CHEST; or two blues, etc. The CHANCE and COMMUNITY CHEST (CC) are considered "wild" and are used to complete any color group. It is to be understood that the use of CHANCE and COMMUNITY CHEST as "wild" may result in the game ending with more than one color group. For example, it is possible that two red properties have been illuminated on the board 20, that one blue property has been illuminated on board 20, and that one purple color has been illuminated. The next play results in the CHANCE light being lit on board 20 which complete three color groups: the red color group, the blue color group, and the purple color group. The game ends and the players making wagers in the group areas 210 for the color groups of red, blue, and purple are paid off according to the payoff schedule of Table I.

3. System Configuration

Figure 3:
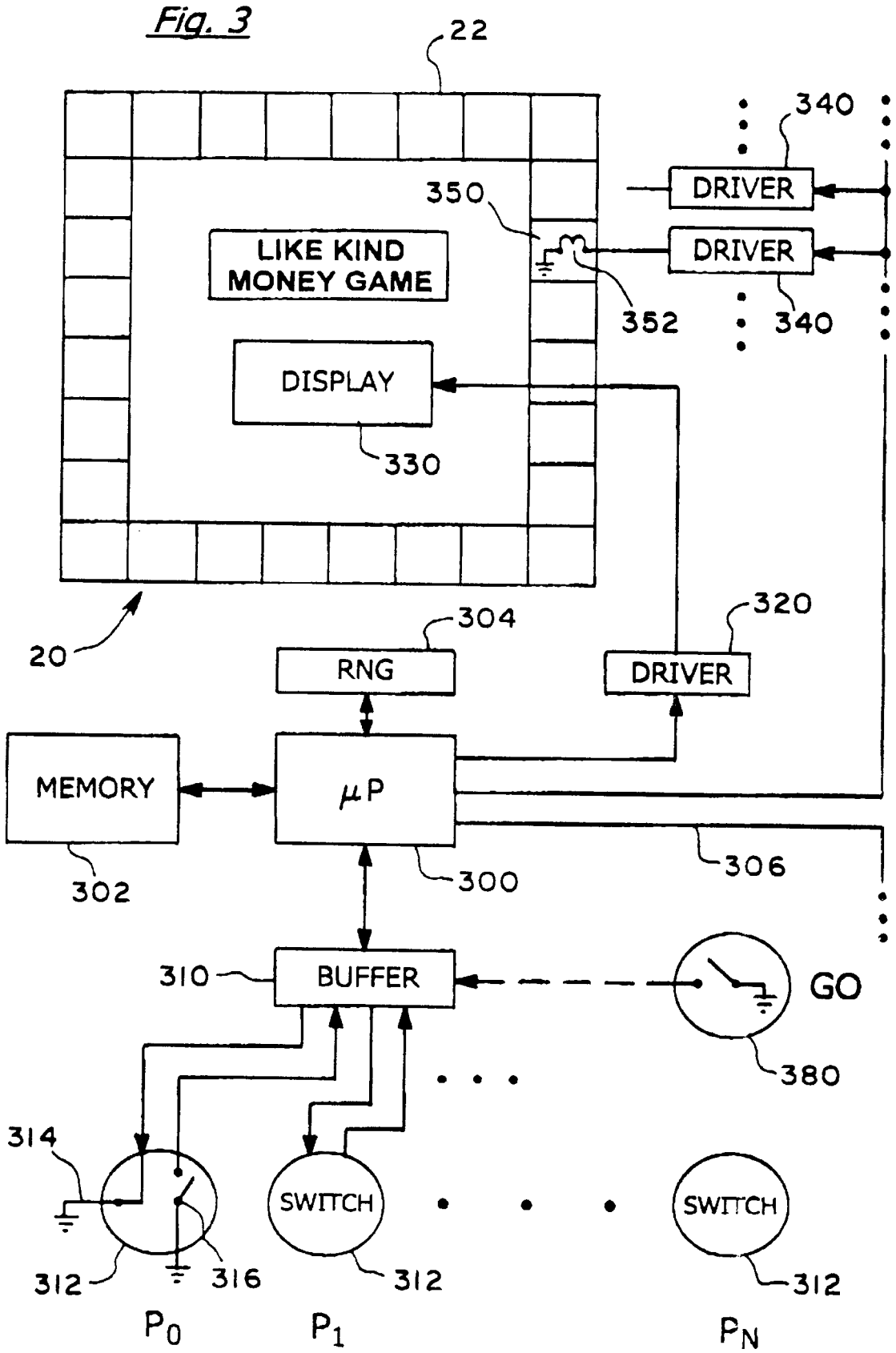
FIG. 3 sets forth the electronic block diagram of the components for the operation of the present invention.

In FIG. 3 is set forth a block diagram showing the system operation of the present invention. In FIG. 3, a microprocessor 300 is shown which is interconnected to a memory 302 and to a random number generator 304. The memory 302 is conventional to personal computer designs and it is to be understood that the microprocessor 300, the memory 302 can be a conventional personal computer such as a PENTIUM-based personal computer. The random number generator 304 is typically software loaded into the personal computer but it is shown in FIG. 3 as a separate component 304 for clarity purposes. The microprocessor 300 is also connected to a buffer circuit 310 which is interconnected to a plurality of switches 312. This will be explained subsequently. While a plurality of switches is shown in FIG. 3, a single switch 312 could be utilized under the teachings of the present invention. Whether one or a plurality of switches are utilized is immaterial to the teachings of the present invention. Switches 312, as shown in FIG. 1, exist at each player position and are usually a large flat switch. As shown in FIG. 3, the switch 312 has a lamp 314 and a switch 316. The microprocessor 300 can selectively through buffer 310 turn on a specific lamp 314 such as the lamp at switch 312 for player position $P_0$. The microprocessor 300 receives through buffer 310 from each switch 312 whether or not the switch has been activated 316. The microprocessor 300 is also connected to a driver circuit 320 which activates and controls a display 330 in the game board 200. The display 320 may be a visual display, an audible display, or a combination of both in a multimedia display. The microprocessor 300 is also interconnected to a plurality of drivers 340 which are connected to each lighted area 350 around the periphery of the board. There are 28 lighted areas 350 around the periphery 22 of the board 20, one lighted area corresponding to each colored area as shown in FIG. 1. Each lighted area has behind it a lamp 352 which is selectively lit by the driver at 340 under control of the microprocessor 300.

The system set forth in FIG. 3 is one of many system approaches to implementing the game of the present invention and is not meant to limit the teachings contained herein. For example, a personal computer having a microprocessor memory and random number generator could be resident at the board 20 and interconnected such as over a network to a number of play tables 30. In this embodiment, the board 20 could be quite large and have many more spaces 350 with more than eight "like-kind" groups 90. Any number of tables 30 could be utilized with each table having a second personal computer with a microprocessor memory functioning to communicate with the large board 20.

In yet another equivalent embodiment, a large board 20 could be provided containing a separate personal computer, random number generator, and memory for controlling the operation of the board 20 as described. However, in this embodiment, individual play stations seating only one player could be provided with each having its own personal computer. This embodiment eliminates the use of a game operator GO since the mechanisms and devices for receiving and placing wagers at such individual stations such as in video poker are well-known. This embodiment is well suited for adapting the teachings of the present invention into an intranet or internet environment. In this embodiment, a representation of the wagering area 50 as shown in FIG. 2 would appear on a video screen and a player by simply touching the appropriate color group wager areas can place wagers which can be automatically deducted from existing credits already in the machine or from wagers manually placed or from other suitable wagering devices such as credit cards, debit cards, player cards, smart cards, etc. Whatever the equivalent embodiment, a player would always have the right to place more than one wager to play the game.

4. Operation

When no players are playing the game 10 of the present invention, the microprocessor 300 is in an attract mode and may have a special attract display program for driving display 330. This could also include flashing all of the lighted areas 350 on and off. It is immaterial what the nature of the display in the attract mode is. The goal is to attract players to play the game 10 of the present invention.

Players approach the game table 30 and under instructions from the game operator GO place wagers in the wager area 50. The following example will be used throughout to explain the operation of the present invention. Assume player P0 places a wager X as shown in FIG. 2 for the green color group. Assume player $P_3$ places a wager Y for one railroad. Finally, assume that player $P_4$ places a wager Z on the light purple individual property area 220.

When the wagers are fully placed the game operator GO instructs players P0, P3, and P4 to push their buttons 312. This informs the microprocessor which players are playing the game. The microprocessor lights the light 314 for player P0 to signal the player P0 to push the switch 316. The microprocessor 300 senses the activation of switch 316 at player position $P_0$ and selects a random number from the random number generator 304 to activate one of the lighted areas 350 around the periphery 22 of the board. This is recorded in memory 302 by the microprocessor 300. The microprocessor 300 then activates light 314 at player position P3 who then pushes button 312 appearing in front of his or her position which also activates the corresponding switch 316. Upon receipt of this activation the microprocessor 300 selects a new random number and activates the randomly selected lighted area 350. This process repeats for player P4. The microprocessor 300 sequentially activates lights 314 for these three players until the game ends. Assume the following game play:

TABLE II

| PLAY ROUND | AREA 350 RANDOMLY SELECTED AND LIGHTED |
|---|---|
| 1 | RR3 |
| 2 | G1 |

TABLE II-continued

| PLAY ROUND | AREA 350 RANDOMLY SELECTED AND LIGHTED |
|---|---|
| 3 | B2 |
| 4 | LP2 |
| 5 | 03 |
| 6 | CC (wild) |

In this example of Table II, the game is over at play round number 6 since a COMMUNITY CHEST (CC) area has been lit. The microprocessor 300 in keeping track of the lighted areas 350 from the random number generator 304 knows that a blue color group exists with the CC wild space thereby ending the game. Hence, the microprocessor 300 announces in display 330 that the blue color group is a winner. The game operator GO observes the wager board in FIG. 2 which shows the wagers X, Y and Z. However, the only winner of this game is player at position P3 who placed wager Y for one railroad. Hence, according to the payout table in TABLE I, the payout is three to two.

In a variation of this game, the switches 312 for the players may be removed and a single switch 380 would be centrally provided on the gaming table 30. The gaming operator GO or any player could push the single switch and activate each play of the game. In addition, the use of buttons 312 may be entirely eliminated as the game 20 could automatically cycle from play to play. To automatically cycle, the microprocessor 300 must simply wait a predetermined time such as two seconds after it lights an area 350 from the previous random selection.

While in the preferred embodiment, a gaming operator GO is used to physically pay off the wagers placed in the wagering area 50 by the various players, an alternate embodiment would provide the wagering area to be appropriately lit to indicate winning combinations thereby making the job easier for the game operator GO and much easier for players to observe the winning combinations.

The microprocessor 300 over bus 306 activates separate drivers 390 on the table 30 which are generally shown in FIG. 2. A driver would exist for each area 210, 220, and 230 shown in FIG. 2. There are a total of 35 separate areas 210, 220, and 230 in FIG. 2. A lamp, not shown, could be included in each area so that when a game is over, the microprocessor 300 over bus 306 can light each color group that wins as well as any individual colored property, as well as the number of railroads. Hence, in our example of Table II above, the color blue area 210 would be illuminated indicating that the blue color group has won, individual colored property lights 220 corresponding to green G1, blue B2, light purple LP2, and orange 03 would also be lit and the area 230 corresponding to one railroad would be lit. The lighting of these areas would aid the game operator GO to pay the players appropriately.

5. Second Embodiment

It is to be understood that what is shown in FIGS. 1 through 3 represents a first embodiment of the present invention adopting the MONOPOLY® board game to a casino game. It is to be expressly understood that fewer or more spaces 350 could be utilized along the periphery. The above example does not utilize the "go to jail" from MONOPOLY® board game. In an alternate embodiment, the spaces 350 around the periphery 22 could more closely correspond to the actual MONOPOLY® game board. In this embodiment, the periphery consists of 32 spaces reminiscent of home game:

22 Colored individual properties (8 color groups)

4 Railroads

2 "Wild" COMMUNITY CHEST spaces

1 "Wild" CHANCE space

1 "Wild" Free Parking space

1 Go To Jail space

1 Start/Go space

"Wild" substitutes for any Colored Property

The periphery would be as follows:

TABLE III

| | | | | | | | | |
|---|---|---|---|---|---|---|---|---|
| FP | Red | Red | Red | RR | Yellow | Yellow | Yellow | Go To Jail |
| Orange | | | | | | | | Green |
| Orange | | | | | | | | Green |
| Orange | | | | | | | | Green |
| RR | | | | | | | | RR |
| Lt Purple | | | | | | | | CC |
| Lt Purple | | | | | | | | Blue |
| Lt Purple | | | | | | | | Blue |
| CHANCE | Lt Blue | Lt Blue | Lt Blue | RR | CC | Purple | Purple | GO |

The following is an example of a pay table:

TABLE IV

| | Pays | House Edge |
|---|---|---|
| Purple color group | 3 to 2 | 14% |
| Light Blue color group | 7 to 1 | 18% |
| Light Purple color group | 7 to 1 | 18% |
| Orange color group | 7 to 1 | 18% |
| Red color group | 7 to 1 | 18% |
| Yellow color group | 7 to 1 | 18% |
| Green color group | 7 to 1 | 18% |
| Blue color group | 3 to 2 | 14% |
| Any specific individual property hit (i.e., color or railroad) | 4 to 1 | 11% |
| 1 Railroad hit | 3 to 2 | 19% |
| 2 Railroad hit | 6 to 1 | 10% |
| 3 Railroad hit | 25 to 1 | 14% |
| 4 Railroad hit | 200 to 1 | 12% |
| Go To Jail | 3 to 1 | 19% |

Average length of play=5.8 "rolls"

Note that the above bets on RR need to be exact. E.g., a bet of "2 RR" wins only if 2 RR are illuminated when the game ends. If less than or more than 2 have been hit, the "2 RR" bet is a loser. If the "Go To Jail" space is hit, the game is over and all players lose.

At the start of this alternate version, all spaces 350 are unlit. Players participate by pushing a large button 312. Each space is equally likely to be chosen by the random number generator 304. Once a property is chosen, it is lighted and remains illuminated until the game ends. The game ends when any color group is completed (e.g., 3 Reds, 2 Reds+1 CHANCE, etc.) or if the "Go To Jail" space is chosen.

The following variations to this embodiment are possible. The "Go To Jail" space when hit causes all Railroad wagers to lose. Furthermore, the railroad wagers could be modified to correspond to a single railroad wager and that single wager would have the following payoffs:

| | |
|---|---|
| If 1 Railroad | Push |
| If 2 Railroads | 3 to 1 |
| If 3 Railroads | 6 to 1 |
| If 4 Railroads | 9 to 1 |
| House Advantage = 4.7% | |

Note that this is now a single wager on Railroad, which pays according to how many Railroads have hit. A "Go To Jail" loses for this railroad bet also.

6. Third Embodiment

This embodiment is similar to the first and second embodiments of the present invention discussed above except that a weighting algorithm is utilized so that each square 350 is not equally likely (i.e., making Boardwalk harder to land on than Baltic, etc.) This keeps the theme of having the blue Boardwalk MONOPOLY® "worth" more.

7. Fourth Embodiment

This embodiment utilizes conventional or mechanical dice to generate random "rolls." The game may start on "GO" square in Table V in the lower-right corner which is not wild. Probabilities and payoffs will be similar to that above.

TABLE V

| | | | | | | | | |
|---|---|---|---|---|---|---|---|---|
| FP | Red | Red | Red | RR | Yellow | Yellow | Yellow | Go To Jail |
| Orange | | | | | | | | Green |
| Orange | | | | | | | | Green |
| Orange | | | | | | | | Green |
| RR | | | | | | | | RR |
| Lt Purple | | | | | | | | Blue |
| Lt Purple | | | | | | | | CC |
| Lt Purple | | | | | | | | Blue |
| CHANCE | Lt Blue | Lt Blue | Lt Blue | RR | Purple | CC | Purple | GO |

8. Fifth Embodiment

This embodiment is similar in function to the second embodiment as decribed but has 40 squares, as in the MONOPOLY® home game. The utilities act like the railroads, namely of a "like-kind" that is not color, hence cannot end the game by completion, and not subject to use by wild elements.

9. Conclusion

What is presented is a new gaming device for a casino environment based upon like-kind groups. The gaming device can be adapted to a conventional board game such as the MONOPOLY® board game. However, without any reference to a board game, the casino game of the present invention functionally operates as follows. Each group 90 may be generally referred to as Gi. A group may be of the same color, same sports team, same sport, same name, same graphic, same number, same alphabet, etc. or any combination thereof. Each group Gi is composed of "like-kind" elements Ei. Each element Ei is a separate identifier within a group. For example, if the group is the same color, then separate identifiers with the group could be: a red shirt, a red flag, and a red car. The identifiers do not need to be of the same class as the above example indicates, but they could also be of the same class such as vehicles (e.g., red car, red truck, and red tractor). In the case of the same sports team group, the identifiers could be well known team players. The mechanism (i.e., random number generator 304) for choosing elements Ei may be random, a weighted random scheme, the use of a random element such as mechanical dice, a wheel spinning, etc. Furthermore, while the elements Ei are arranged in groups Gi adjacent each other a shown in FIG. 1, it is to be expressly understood that they need not be adjacent and may be arranged in any fashion around the periphery 22 of the board 20.

The player may wager on which of the groups Gi will be the first to be completed (e.g., colored group). Other elements E on the board 10 act as "wild" elements and may substitute for any element Ei within certain groups Gj (e.g., CC and CHANCE). Other elements Ek on the board 10 have no effect on game play (e.g., GO). Other elements El on the board 10 are grouped such that players are rewarded based on how many of the group are hit prior to game ending (e.g., RR). Other elements Em on the board 10 cause the game to immediately end (e.g., Go To Jail), and may/may not cause all wagers to lose. Other elements En could cause all players to win. It is to be expressly understood that under the teachings of the present invention one or more, in any combination, of elements Ej, Ek, El, Em, En could be used to provide a game such as shown in FIG. 1 based upon the teachings of the present invention disclosed herein.

The above disclosure sets forth a number of embodiments of the present invention. Those skilled in this art will however appreciate that other arrangements or embodiments, not precisely set forth, could be practiced under the teachings of the present invention.

The following summarizes some, but not all of the inventive features contained herein:

What is claimed is:

1. A casino game comprising:

an electronic play board, game elements grouped on the electronic play board comprising at least these:
- like kind elements,
- wild elements,
- lose elements, and
- separate wager elements, the electronic play board with several groups of the game elements thereon, each group having at least one of the game elements;

a wagering table;

separate areas for wagering placement and winnings distribution on the wagering table, the separate wager areas for wagering on the occurrence of a group, or the occurrence of at least one separate wager element;

a device for randomly and sequentially selecting next game elements during each play of the game until either:
- all of the game elements in one group have been selected or a randomly selected wild element completes one group, the device displaying on the electronic play board randomly and sequentially selected game elements in their respective group;

the device causing the game to end upon completion of a round of play, and a memory within the device and coupled to the electronic play board, the memory including the rules of game play for automatically relating game play by continually displaying each of the selected game elements on the electronic play board during each round of play, the memory designed to continue to operate the casino game until collection of a like kind group is completed or the casino game is ended.

2. A game for casino play, wagering and environs, comprising a playing board for game play by one or more players and a wagering area, the game comprising:

an electronic display board viewable by the one or more players;

a random number generator coupled to the electronic display board, the random number generator operatively coupled to deliver the game play to the one or more players in the form of random occurrences;

a wagering area for placement of one or more wagers on random occurrences on the electronic display board during the game play, the wagering area for placing bets and for placement of winnings;

a system configuration coupled to the electronic display board to automatically relate the game play when the random number generator delivers game play and the electronic display board displays thereabout the random occurrences, the system configuration for causing the game to end in one move only when at least a preset random occurrence is selected;

a memory in the system configuration, the memory including game play rules, the memory designed to continue display of randomly selected occurrences and for operating the casino game until a like kind group of randomly selected occurrences is completed on the electronic display board or the casino game is ended according to automatically related game play.

3. The game for casino play of claim 2 wherein said wagering area is operatively coupled to the electronic display board and responsive to the game play.

4. The game for casino play of claim 2 wherein said wagering area is operatively coupled to the system configuration for determining winnings for the one or more wagering players.

5. A game for casino play, wagering and environs, the board game having a playing board for game play by one or more players, the game comprising:

an electronic display board viewable by the one or more players;

a plurality of groups positioned about the electronic display board, the plurality of groups related to the game play;

a plurality of game elements in each of the plurality of groups, the plurality of game elements in each of the group being of like kind;

a random number generator coupled to the electronic display board, the random number generator operatively coupled to sequentially and randomly select game elements for the one or more players and to display the randomly selected game elements on the electronic display board;

an identifier for each of the game elements to establish its relationship with respect to other game elements of like kind, each identifier shown on the electronic display board for view by the players;

a wagering area for placement of one or more wagers on randomly selected occurrences of like kind elements on the electronic display board during the game play, the wagering area to distribute winnings;

a system configuration coupled to the electronic display board to automatically relate the game play when the random number generator selects at least two like kind elements and the electronic display board displays the random selection of game elements about the electronic display board when the one or more players complete a group and end the game play, and a memory in the system configuration, the memory including game play rules, the memory to automatically relate game play, the memory connected to the electronic display board for continuing the display of the randomly selected game elements, the memory designed to continue to operate the casino game until a like kind group is completed or the casino game is ended.

6. The game of claim 5 wherein said wagering area is operatively coupled to the electronic display board.

7. The game of claim 5 wherein the system configuration is coupled to the wagering area and the electronic display board for determining when identifiers have been randomly selected for each of the one or more players in sufficient quantity to distribute a win to the one or more wagering players.

8. The game for casino play of claim 5 wherein the electronic display board includes wild areas, each wild area randomly selected during the mode of play, each such randomly selected wild area optionally available to the player for use as at least one identifier.

9. The game of claim 5 wherein the system configuration couples to the electronic display board and the wagering area and relates automatically the game play for determining winnings for the one or more wagering players.

10. The game of claim 5 wherein the random number generator exhibits one or more dice.

11. The game of claim 2 wherein the random number generator illuminates an element on the game board.

* * * * *